United States Patent [19]

Sakai et al.

[11] 4,446,058

[45] May 1, 1984

[54] RESISTOR COMPOSITION FOR RESISTOR-INCORPORATED SPARK PLUGS

[75] Inventors: Masao Sakai, Kasugai; Miyakazu Hashizume, Aichi; Yasuhiko Suzuki, Aichi; Makoto Sugimoto, Aichi, all of Japan

[73] Assignee: NGK Spark Plug Co., Ltd., Aichi, Japan

[21] Appl. No.: 393,305

[22] Filed: Jun. 29, 1982

[30] Foreign Application Priority Data

Jul. 16, 1981 [JP] Japan ..... 56-109971

[51] Int. Cl.[3] ..... H01B 1/06

[52] U.S. Cl. ..... 252/507; 252/508; 252/509; 252/504; 252/505; 252/506

[58] Field of Search ..... 252/504, 505, 506, 507, 252/508, 509, 518; 501/22, 55, 60, 67, 61, 53; 315/58

[56] References Cited

U.S. PATENT DOCUMENTS

| | | | |
|---|---|---|---|
| 3,909,459 | 9/1975 | Friese et al. | 252/509 |
| 3,929,674 | 12/1975 | Patterson | 252/518 |
| 3,943,168 | 3/1976 | Patterson | 252/518 |
| 4,018,717 | 4/1977 | Francel et al. | 252/518 |
| 4,051,074 | 9/1977 | Asada et al. | 252/506 |
| 4,070,517 | 1/1978 | Kazmierowicz | 252/518 |
| 4,097,653 | 6/1978 | Patterson et al. | 252/519 |
| 4,173,731 | 11/1979 | Takagi et al. | 252/506 |

*Primary Examiner*—Josephine Barr

*Attorney, Agent, or Firm*—Wegner & Bretschneider

[57] ABSTRACT

A resistor composition for resistor-incorporated spark plugs, substantially consisting of 100 parts of a base mixture consisting of 30 to 70% of glass frit and the balance of inorganic aggregate; 0.1 to 7.0 parts, calculated on carbon upon sintering, of a carbonaceous material; and 0 to 30 parts of an agent for stabilizing resistance of the resistor under load, the glass frit containing 10 to 100% of lead glass having a PbO content of 30 to 88% and a softening point of 300° to 600° C. with the balance of a glass having a softening point exceeding 500° C., each by weight ratio.

12 Claims, 2 Drawing Figures

RESISTOR COMPOSITION FOR RESISTOR-INCORPORATED SPARK PLUGS

BACKGROUND OF THE INVENTION

The present invention relates to a resistor composition for resistor-incorporated spark plugs, and more specifically to improvements in the resistance properties of the resistor, upon sealing, relying upon glass as a binder of the resistor.

Generally, conventional resistor compositions for resistor-incorporated spark plugs have been basically made up of inorganic components (referred to "base mixture" hereinafter), i.e., glass frit and inorganic aggregate, the aggregate substantially consisting of alumina, zircon, mullite, silica, clay, silicon nitride, boron nitride, aluminum nitride or the like or a mixture of these substances, and a carbonaceous material, the carbonaceous material encompassing carbon black, graphite or other organic substances capable of being carbonized by sealing/heating such as, for instance, glycerol, methyl cellulose, polyvinyl alcohol and the like. To further improve the stabilizing properties of the resistor with respect to resistance under load, one may use per 100 parts by weight of the aforesaid base mixture, 0 to 30 parts by weight of one or more components selected from the group consisting of oxides and carbides of rare earth elements and metals (Ti, Nb, Cr, etc.) of subgroups IVa, Va and VIa of the long period type periodic table (Iwanami Rikagaku Jiten, the third edition, pp. 1484–5), carbide of B or Si, and the like.

Borosilicate glass and barium borate glass are known in the art as glasses used to this end.

Such resistor compositions are charged in an insulator center bore of a spark plug, which is usually sealed to form a resistor body between a center electrode and a terminal rod, both being inserted in the center bore by means of a conductive sealing glass powder usually interposed between the resistor body and the center electrode or the terminal rod.

This resistor body has to be sealed so as to produce a given resistance value in order to prevent occurrence of radio frequency interference on ignition of the spark plug. However, conventional resistor compositions undergo variation in the resistance value depending upon the sealing temperature. Thus, it is difficult to obtain a desired constant resistance value in the spark plug, thus requiring stringent sealing temperature control for its preparation.

SUMMARY OF THE DISCLOSURE

It is therefore a main object of the present invention to provide a novel resistor composition for resistor-incorporated spark plugs, having a reduced variation in the resistance value depending upon sealing temperature.

According to the present invention, a resistor composition is provided in which, as its glassy components, use is made of a glass frit consisting essentially of 10 to 100% by weight of lead glass comprising 30 to 88% by weight of PbO and having a softening point of 300° to 600° C., with the balance being a glass having a softening point exceeding 500° C.

This and other objects and features of the present invention will become apparent from the following description of preferred embodiments of the invention.

In the present invention, the variation in the resistance value depending upon the sealing temperature can be represented by a dependency index A which is defined by the following formula (1):

$$A = \frac{R_1 - R_2}{R_1} \times \frac{1}{T_2 - T_1} \times 100\ [\%/°c.] \quad (1)$$

wherein:

$T_1$ represents a low sealing temperature (°C.), $T_2$ represents a high sealing temperature (°C.) of $T_1$ plus $\Delta T$°C., and $R_1$ and $R_2$ represent resistance values sealed at $T_1$ and $T_2$, respectively.

As $\Delta T$, a temperature difference of 50° C. is adopted as a practical matter.

Provided that $\Delta T$ is 50° C. and $T_1$ is 930° C., it has turned out that the index A for conventional resistor compositions amounts to 0.9–1.4 or more, such values being, in view of the present invention, high and causing the difficulties aforementioned.

According to the present invention, the preferred embodiments realize significantly reduced index A values, in different steps, e.g., of each not exceeding 0.75, 0.71, 0.6, 0.5, 0.4 and 0.3, the lowest being 0.2 when measured at a sealing temperature $T_1$ of 930° C. It should be noted, however, that this index A widely varies depending upon the sealing temperature $T_1$.

A number of embodiments of the present invention exhibit reduced index A values with other good properties requisite to spark plug resistor composition. The purpose of the invention is attained through wholly or partly substituting the inventive lead glass for known sealing glass compositions.

Preferred combinations of the inventive lead glass with the components for the known spark plug resistor compositions will be exemplified in the following disclosure.

DETAILED DESCRIPTION OF THE INVENTION

Figure 1:
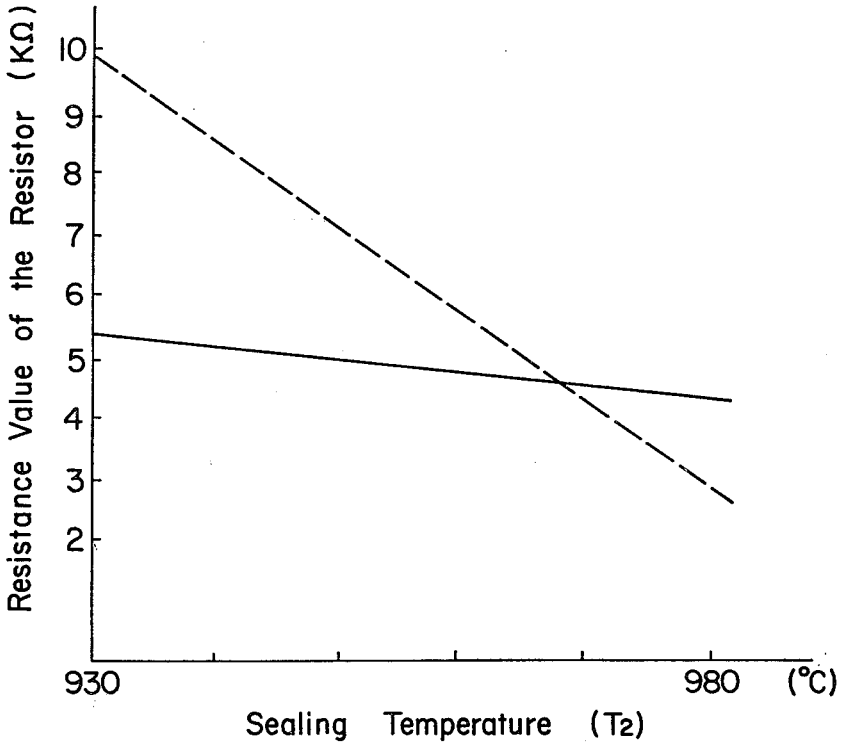
FIG. 1 shows the relation of the resistance value (KΩ) of the resistor vs. sealing temperature ($T_2$°C.) graph representing the dependency of the resistance of resistor upon the sealing temperature, in which a solid line and dotted line show the invention and the prior art, respectively.

As a binder for spark plug resistors, for instance, borosilicate glass or barium borate glass has been conventionally used.

As this glassy binder, the present invention contemplates using a glassy material consisting essentially of 10 to 100% by weight of lead glass having a PbO content of 30 to 88% by weight and a softening point of 300° to 600° C. with the balance being glass normally available for conventional spark plug resistors, provided that the latter glass has a softening point above 500° C.

The lead glass which possesses the above-mentioned properties (referred to "lead glass" hereinafter) and which is used in the present invention, is basically made up of the following composition by weight ratio: 30–88% PbO, 0–45% $SiO_2$, 0–50% $B_2O_3$, 0–5% $Al_2O_3$, 0–20% of mixtures of $Na_2O$ plus $K_2O$ plus $Li_2O$, 0–5% of mixtures of CaO plus MgO plus Bao and 0–30% ZnO, and may additionally contain other known glass-forming substance(s). As the additional component(s), for instance, $SnO_2$ is known in the art, and may be used in an amount of 0 to 2% by weight.

The lead glass referred to above is generally known as soldering glass or crystalline soldering glass, and includes glasses having a PbO content requisite for the present invention and other required properties. Table 1 lists typical examples of the lead glasses used in the present invention.

The lead glass is prepared in known manners, pulverized to a suitable particle size and fritted for use. As such lead glass, use may be made of the so-called metallizing lead glass that is applied for metallizing conductive thin films designed for use in microcircuits. For instance, it is possible to employ lead glasses comprising a substantial amount of a $PbO$-$SiO_2$-$B_2O_3$ system and a minor amount of $Al_2O_3$, CaO, MgO etc., if required, as disclosed in the following U.S. Pat. Nos. 4,097,653; 3,929,674; 4,070,517; and 3,943,168. In addition, use may also be made of glasses known as sealing glass frits for cathode ray tubes such as, for example, a $PbO$-$B_2O_3$-ZnO system glass (optionally containing $SiO_2$, BaO and $SnO_2$) as is disclosed in, e.g., U.S. Pat. No. 4,018,717.

If the lead glass has a PbO content below 30% by weight, the effect provided by the present invention is not sufficiently obtained. At a PbO content exceeding 88% by weight, on the other hand, the softening point of the resulting composition is too low. Thus, if a resistor composition whose PbO content does not fall within the above-defined range is used in an actually working engine, problems will arise, i.e., difficulties will be encountered in securing the sealing or fixing of the center electrode and terminal rod in place, variation in resistance will be brought about, etc.

Even if the lead glass (PbO content: 30–88% by weight) is mixed with the balance glass, it can exhibit a softening point of at least 300° C. and, hence, can be used in accordance with this invention as a resistor binder sealed in the spark plugs without any problem.

the glasses suitable for this purpose include $B_2O_3$-BaO system glasses, borosilicate glasses, borosilicate-Ba system glasses, borosilicate-zinc system glasses, etc. For instance, use may be made of $B_2O_3$-BaO (or additionally $Na_2O$-CaO) system glasses as disclosed in Japanese Patent Publication No. 47-22505; borosilicate glasses as specified in Table 2 (including borosilicate Li or borosilicate Li-Ca system glasses containing 2% by weight of $Na_2O$ or $K_2O$, as disclosed in Japanese Laid-open Application No. 49-68131); glasses as disclosed in Japanese Laid-open Application Nos. 50-27983 and 49-68130, Japanese Patent Publication No. 47-22505, etc.; a glass consisting of, by weight ratio, 38% $SiO_2$, 15% $B_2O_3$, 18% BaO, 7% $Al_2O_3$, 8% ZnO and 10% CaO plus MgO, as disclosed in U.S. Pat. No. 3,943,168. The disclosures of Japanese Patent Publication No. 47-22505, Japanese Laid-open Applications Nos. 50-27983 and 49-68130, and U.S. Pat. Nos. 3,943,168; 3,929,674; and 4,070,517; are hereby incorporated by reference into the present Specification.

The BaO-containing glass is preferable in that it shows improved compatibility or wettability relative to the carbonaceous substances. A glass consisting of, by weight ratio, 5% PbO, 30% $B_2O_3$ and 65% $SiO_2$ as disclosed in Japanese Laid-open Application No. 50-27983 is also useful.

Table 3 lists preferable Ba-borosilicate glasses and Ba-borate glasses.

According to the present invention, the base mixture (glass plus inorganic aggregate) contains 30 up to 70% by weight of glass. If the glass content is below 30% by weight, one may encounter difficulties in inserting the terminal rod (a male screw) through hot-pressing and in bonding the resistor composition to the inner wall of the insulator centerbore.

Figure 2:
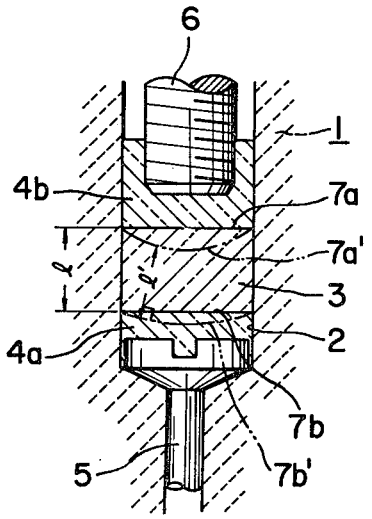
FIG. 2 is a schematic view of a resistor in the sealed state.

If the glass content exceeds 70% by weight, on the other hand, the interfacial plane between the resistor body and conductive sealing glass is not at a right angle to the longitudinal axis of the insulator centerbore during the hot-pressing thereof, wherein, as shown in FIG. 2, the upper and lower interfaces or end faces (lines *7a*, *7b*) of the resistor body are rounded, as shown by dot-dash lines *7a'*, *7b'*, resulting in an effective length l' which is shorter than a given design length (as shown at l). This makes it difficult to obtain the desired resistance, and leads to deterioration in the desired noise suppression effect.

TABLE 1

| Components of the lead glasses by weight % | | | | | | | | | | | |
|---|---|---|---|---|---|---|---|---|---|---|---|
| PbO | $B_2O_3$ | $SiO_2$ | $Na_2O$ | $K_2O$ | $Li_2O$ | ZnO | CaO | BaO | $Al_2O_3$ | other components | softening point °C. |
| 83 | 17 | | | | | | | | | | 360 |
| 74 | 26 | | | | | | | | | | 430 |
| 54 | 41 | 5 | | | | | | | | | 590 |
| 80 | 13 | 3.5 | | | | | | | 3.5 | | 395 |
| 85 | 7.5 | 7.5 | | | | | | | | | 370 |
| 88 | 12.0 | | | | | | | | | | 330 |
| 30 | 1.4 | 45.0 | 6 | | | | 3.6 | | | | 480 |
| 64 | 11.9 | 5.0 | | | | 19.0 | | | | | 375 |
| 72 | 18.0 | 2.5 | | | | 5.0 | | | 2.5 | | 430 |
| 43.5 | 4.9 | 37.5 | | | | | 9.8 | | 4.3 | | 580 |
| 75 | 8.3 | 2.1 | | | | 12.6 | | 2.0 | | | |
| 75–86 | 8–15 | 0–5 | | | | 0–16 | | 0–2 | | $SnO_2$ 0–2 | |
| 45–50 | 50–55 | | | | | | | | | | 540 |

To achieve the objects of the present invention, the overall glassy components generally have a PbO content of at least 0.9% by weight, and the lead glass having a PbO content 30% by weight or higher is best suited for that PbO source.

The balance glass used in addition to 10 to 100% by weight of the lead glass may be glasses known as being applied to the prior art spark plug resistors. Examples of

TABLE 2

| glass composition | Borosilicate Glasses % by weight Components $SiO_2$ | $B_2O_3$ | $Al_2O_3$ | PbO | $Na_2O$ | $K_2O$ | $Li_2O$ | CaO | MgO | ZnO |
|---|---|---|---|---|---|---|---|---|---|---|
| | Composition range | | | | | | | | | |
| | 10–80 | 7–50 | 0–20 | 0–25 | 0–10 | | | 0–10 | | 0–40 |
| A | 55 | 30 | 5 | 5 | 5 | | | | | |
| B | 65 | 25 | 6 | | | 4 | | | | |
| C | 50 | 18 | 7 | 25 | | | | | | |
| D | 65 | 23 | 5 | | 7 | | | | | |
| E | 65 | 30 | | 5 | | | | | | |
| F | 56.0 | 33.5 | 0.8 | | 4.4 | | 1.7 | 3.4 | | |
| G | 60.1 | 7.1 | 18.5 | | 0.6 | 0.5 | 6.3 | | 6.9 | |
| H | 10.1 | 45.5 | | | 7.4 | | | | | 37.0 |

TABLE 3

| glass composition | Components $SiO_2$ | $B_2O_3$ | $Al_2O_3$ | $Na_2O$ | $K_2O$ | $Li_2O$ | CaO | MgO | ZnO | BaO |
|---|---|---|---|---|---|---|---|---|---|---|
| I | | 75 | | | | | | | | 25 |
| J | | 60 | | 6 | | | 2 | | | 32 |
| K | | 60 | | 2 | | | | | | 38 |
| L | 38 | 15 | 7 | | | | 5 | 5 | 8 | 18 |
| M | 57.1 | 21.2 | 10.3 | 0.16 | 0.48 | | 6.9 | | | 3.6 |

The inorganic aggregates include oxides, silicate minerals, etc., either crystalline or non-crystalline, which are usually ceramic raw materials such as, for instance, alumina, zircon, mullite, silica, clay and the like, and encompass heat-resistant, powdery materials of poor electrical conductivity. Beside the above materials, the inorganic aggregates may contain at least one of a nitride such as, for instance, silicon nitride, boron nitride or aluminium nitride.

These inorganic aggregates are added in order to afford heat resistance to the resistor body and prevent the resistor body from being rounded at its interfaces. In particular, the addition of the aforesaid nitrides in an amount of 0.1% by weight or higher is more advantageous for further improving the noise-suppression effect.

As well-known in the art, the resistor composition may contain, in addition to the foregoing base mixture, a given amount of a carbonaceous material (carbon black, graphite and powdery pitch, and other organic substance that is capable of being carbonized during sintering) for adjusting its resistance. The carbonaceous substance is added in an amount of 0.1 to 7% by weight—calculated on carbon upon sintering—per 100 parts by weight of the said base mixture. In general, the application of the carbonaceous substance in an amount below 0.1% by weight leads to an excessive increase in resistance, whereas a drop of resistance takes place in an amount above 7% by weight; in either case, the desired noise suppression effect is not obtained.

Preferably, the organic substances capable of being carbonized during sintering serve as a binder for the powdery resistor composition. To this end, known organic binder substances are usually employed, including water-soluble organic binders such as, for instance, dextrin, CMC, methyl cellulose, glycerol, sucrose, lactose, maltose, glucose, xylose, PVA and the like, or lubricating binders such as, for example, paraffin wax.

Preferably, the resistor composition according to the present invention contains an agent for stabilizing the durable life of the resistor under load, viz., for stabilizing a change in resistance with time during use at a high temperature, in a quantity of 0 to 30 parts by weight per 100 parts by weight of the aforesaid base mixture. Although this stabilizing agent is identical with that to be added to a conductive sealing glass material it has turned out that a similar effect is attained by adding it to the resistor composition per se, as disclosed in Japanese Laid-Open Application Nos. 50-27983 and 50-27984.

Even in the case where this stabilizing agent is added, the glass content as contained in the base mixture should be preferably 30% by weight or more of the total inorganic substances in the resistor composition.

As disclosed in the foregoing Laid-Open Application No. 50-27985, it is noted that the stabilizing agent is also preferably added to the conductive sealing glass to be used for sealing the resistor body contiguous to the end of the resistor body.

Upon sintering, the resistor according to the present invention attains a specific resistance of approximately 10 to $1\times10^3\Omega$ cm. Usually, sintering and compression (hot-pressing) are effected in such a manner that a resistor having a specific resistance of approximately 1 to 10 $K\Omega$, more generally 3 to 7.5 $K\Omega$, is obtained in the insulator center bore. The hot-pressing applied in the present invention comprises the steps of inserting or forming beforehand a center electrode or an alternative electrode member in the insulator center bore, charging therein a conductive sealing glass, a resistor composition and, again, a conductive sealing glass at a pressure of about 1500 to 2000 kg/cm$^2$, respectively, inserting a terminal rod therethrough and heating it to 900° to 1000° C. to put the glass in a softened state, and hot-pressing the terminal rod along its axial direction under a load of about 30 to 70 kg weight.

It is noted that the conductive sealing glass used has a sealing temperature coincident with that of the resistor.

The resultant resistor-incorporated spark plug undergoes little or no fluctuation in resistance dependent upon its heating (sintering) temperature, can easily be controlled in the heating procedure, is of constant quality, and can be manufactured with improved yields. According to the present invention, therefore, it is possible to achieve faithful reproduction of the resistance corresponding to the predetermined constant composition, thus facilitating or simplifying the production and design of resistor-incorporated spark plugs.

The present invention will now be elucidated with reference to the following non-restrictive examples, in which "%" and "part(s)" are given by weight ratio.

Without departing from the concept of the present invention as claimed and disclosed in the specification, any variations or modifications which are apparent in the art will be made.

EXAMPLE 1

The glasses having the compositions as shown in Table 4 were prepared in advance, comminuted and sieved on a JIS 150 mesh. The thus sieved out matter was fritted. Table 4 also shows the softening point of each frit sample. The prefix R denotes comparative samples.

Using the frits of Table 4, the resistor compositions were prepared in the proportions as specified in Table 5. The aggregates used all passed through the JIS 150 mesh. As Glass I and Glass II, a prior art glass frit (PbO content: 25% by weight or less) and a glass frit having a PbO content of 30% by weight or higher were used, respectively.

A total of 100 parts of Glass I plus Glass II plus aggregate were mixed with 0.7 parts—calculated on carbon—of glycerol, and the resulting mixture was uniformly mixed in a ball mill for three hours resulting in a powdery resistor composition. After a center electrode (diameter: 4.7 mm) had been inserted in an insulator center bore, 0.2 grams of a conductive sealing glass (obtained by mixing the sample A of Table 2 with copper powder in a mixing ratio of 1:1), 0.5 grams of the powdery resistor composition, and, again, 0.2 grams of the same conductive sealing glass were charged therein at a pressure of 2000 kg/cm$^2$, respectively, followed by insertion of a terminal rod. The thus assembled mass was heated up to temperatures $T_1$ and $T_2$, respectively, provided that $T_1$ was 930° C. and $T_2$ equalled $T_1+50°$ C., to put the glass frits in a softened state and, at the same termperature, a load of about 40 Kg weight was applied on the upper end of the terminal rod for hot-pressing.

After the spark plugs had been allowed to cool, the resistance of the resistor interposed between the center electrode and the terminal rod was measured. The results are set forth in Table 5.

FIG. 1 represents the dependency of the resistance of sample No. 8 upon the sealing temperature (in %/°C.) by a solid line. In this graphical view, the dotted line indicates the measurements of comparative sample No. R1.

From FIG. 1, it turns out that, even with the glass frits having a similar softening point, there is a significant difference in the dependency of the resistance upon the sealing temperature between the glass having a PbO content of 30% by weight or higher and the PbO-free glass.

It has also been found that increasing dependency of the resistance of PbO-free glass upon the sealing temperature can be counteracted by the addition of PbO-containing glass thereto, thus making contribution to the improvement in the stability of the resistance at a given sealing temperature.

TABLE 4

| Frit No. | PbO | $B_2O_3$ | $SiO_2$ | $Na_2O$ | ZnO | CaO | $Al_2O_3$ | $K_2O$ | softening point (°C.) |
|---|---|---|---|---|---|---|---|---|---|
| 1 | 83 | 17 | | | | | | | 360 |
| 2 | 74 | 26 | | | | | | | 430 |
| 3 | 54 | 41 | 5 | | | | | | 590 |
| 4 | 30 | 10 | 55 | 5 | | | | | 570 |
| R 5 | 30 | | 57 | 6 | | | 1 | 6 | 630 |
| R 6 | 25 | 20 | 40 | 15 | | | | | 580 |
| 7 | 80 | 13 | 3.5 | | | | 3.5 | | 395 |
| 8 | 88 | 12 | | | | | | | 330 |
| 9 | 30 | 1.4 | 45 | 6 | | 3.6 | | 14 | 480 |
| R 10 | | 45.5 | 10.1 | 7.4 | 37.0 | | | | 575 |

$$A = \frac{R_1 - R_2}{R_1} \times \frac{1}{T_2 - T_1} \times 100 \text{ (\%/°C.)} \quad (1)$$

$T_1$: Sealing temperature °C. (low)

$T_2$: Sealing temperature °C. (high, $=T_1+50°$ C.)

$R_1$: Resistance value of a sample sealed at $T_1$ (measured at normal temp.)

$R_2$: Resistance value of a sample sealed at $T_2$ (measured at normal temp.)

TABLE 5

| Sample No. | Glass I (Frit R 10) parts by weight | Glass II Frit No. | Glass II parts by weight | Aggregate Type | Aggregate parts by weight | Dependency of resistance upon sealing temperature A(%/°C.) |
|---|---|---|---|---|---|---|
| R 1 | 50 | 2 | 0 | $Si_3N_4$ | 50 | 1.40 |
| 2 | 47 | " | 3 | " | 50 | 0.60 |
| 3 | 40 | " | 10 | " | 50 | 0.57 |
| 4 | 0 | " | 50 | " | 50 | 0.22 |
| 5 | 0 | " | 70 | " | 30 | 0.20 |
| 6 | 0 | " | 30 | " | 70 | 0.57 |
| 7 | 25 | 1 | 25 | " | 50 | 0.28 |
| 8 | 25 | 2 | 25 | " | 50 | 0.33 |
| 9 | 25 | 3 | 25 | " | 50 | 0.39 |
| 10 | 25 | 4 | 25 | " | 50 | 0.53 |
| R 11 | 25 | R 5 | 25 | " | 50 | 0.92 |
| R 12 | 25 | R 6 | 25 | " | 50 | 0.91 |
| 13 | 25 | 7 | 25 | " | 50 | 0.28 |
| 14 | 25 | 8 | 25 | " | 50 | 0.22 |
| 15 | 25 | 9 | 25 | " | 50 | 0.57 |
| 16 | 25 | 2 | 25 | $Al_2O_3$ | 50 | 0.38 |

TABLE 5-continued

| Sample No. | Glass I (Frit R 10) parts by weight | Glass II Frit No. | Glass II parts by weight | Aggregate Type | Aggregate parts by weight | Dependency of resistance upon sealing temperature A(%/°C.) |
|---|---|---|---|---|---|---|
| 17 | 25 | " | 25 | Clay | 50 | 0.36 |
| 18 | 25 | " | 25 | Zircon | 50 | 0.38 |
| 19 | 25 | " | 25 | $SiO_2$ | 50 | 0.36 |
| 20 | 25 | " | 25 | Mullite | 50 | 0.37 |
| 21 | 25 | " | 25 | AlN | 50 | 0.33 |
| 22 | 25 | " | 25 | BN | 50 | 0.35 |
| 23 | 45 | 4 | 5 | $Si_3N_4$ | 50 | 0.67 |
| 24 | 27 | " | 3 | " | 70 | 0.71 |
| 25 | 63 | " | 7 | " | 30 | 0.55 |

What is claimed is:

1. A resistor composition for resistor-incorporated spark plugs, consisting essentially of 100 parts by weight of a base mixture consisting essentially of 30 to 70% by weight of glass frit and the balance of an inorganic aggregate consisting essentially of one or more substances selected from the group consisting of alumina, zircon, mullite, silica, clay, silicon nitride, aluminum nitride and boron nitride;

0.1 to 7.0 parts by weight, calculated as carbon on sintering, of a carbonaceous material;

and 0 to 30 parts by weight of an agent for stabilizing the resistance of the resistor under load, wherein the glass frit contains 10 to 100% by weight of lead glass having a PbO content of 30 to 88% by weight and a softening point of 300° to 600° C., the balance of the glass frit being a glass having a softening point which exceeds 500° C.

2. The resistor composition as defined in claim 1, wherein said lead glass consists essentially of, by weight ratio, 30 to 88% PbO, 0 to 45% $SiO_2$, 0 to 50% $B_2O_3$, 0 to 5% $Al_2O_3$, 1 to 20% of mixtures consisting of $Na_2O$ plus $K_2O$ plus $Li_2O$, 0 to 5% of mixtures consisting of CaO plus MgO plus BaO, 0 to 30% ZnO and 0 to 2% $SnO_2$.

3. The resistor composition as defined in claim 1, wherein said balance of glass frit having a softening point exceeding 500° C. is one or more selected from the group consisting of borosilicate glass, barium borate glass and borosilicate zinc glass, those glasses containing 0 to 25% by weight of PbO.

4. The resistor composition as defined in claim 1, wherein said stabilizing agent consists essentially of one or more selected from the group consisting of oxides and carbides of rare earth elements and metal of subgroups IVa, Va and VIa of the periodic table, MgO, ZnO, $B_4C$, SiC, TiB and TiN.

5. The resistor composition as defined in claim 4, wherein said stabilizing agent consists essentially of one or more selected from the group consisting of $TiO_2$, $ZrO_2$, $ThO_2$, $Nb_2O_5$, $TaO_5$, $Cr_2O_3$, $La_2O_3$, TiC, VC, NbC, TaC, $Cr_3C_2$, $MO_2C$, WC, $LaC_2$, MgO, ZnO, $B_4C$, SiC, TiB and TiN.

6. The resistor composition as defined in claim 1 or 2, wherein said lead glass has a softening point of 330° to 590° C.

7. The resistor composition as defined in claim 1, wherein said resistor composition has a dependency index A of the resistance upon the sealing temperature of not exceeding 0.75, the index A being defined by the following formula:

$$A = \frac{R_1 - R_2}{R_1} \times \frac{1}{T_2 - T_1} \times 100\ [\%/°C.]$$

wherein $T_1$ represents a low sealing temperature (°C.), $T_2$ represents a high sealing temperature (°C.) of $T_1$ plus 50° C., $R_1$ represents the resistance value sealed at $T_1$, and, $R_2$ represents the resistance value sealed at $T_2$, measured at $T_1$ of 930° C.

8. The resistor composition as defined in claim 7, wherein the index A does not exceed 0.71.

9. The resistor composition as defined in claim 7, wherein the index A does not exceed 0.6.

10. The resistor composition as defined in claim 7, wherein the index A does not exceed 0.5.

11. The resistor composition as defined in claim 7, wherein the index A does not exceed 0.4.

12. The resistor composition as defined in claim 7, wherein the index A does not exceed 0.3.

* * * * *